US008192251B2

(12) United States Patent
Hsueh et al.

(10) Patent No.: US 8,192,251 B2
(45) Date of Patent: Jun. 5, 2012

(54) PRESSURE CONTROL SYSTEM OF WAFER POLISHING APPARATUS

(75) Inventors: Yueh Cheng Hsueh, Hualien (TW); Chin Wei Wu, Jhongli (TW); Sheng-Feng Hung, Taipei (TW)

(73) Assignee: Inotera Memories, Inc., Taoyuan County (TW)

( * ) Notice: Subject to any disclaimer, the term of this patent is extended or adjusted under 35 U.S.C. 154(b) by 471 days.

(21) Appl. No.: 12/458,303

(22) Filed: Jul. 8, 2009

(65) Prior Publication Data

US 2010/0203807 A1 Aug. 12, 2010

(30) Foreign Application Priority Data

Feb. 6, 2009 (TW) ..... 98103972 A

(51) Int. Cl.
*G05D 16/20* (2006.01)
*B24B 51/00* (2006.01)

(52) U.S. Cl. ..... 451/67; 137/625; 451/288; 451/388

(58) Field of Classification Search ..... 451/11, 451/65, 67, 288, 388, 398; 137/487.5, 625
See application file for complete search history.

(56) References Cited

U.S. PATENT DOCUMENTS

| | | | | |
|---|---|---|---|---|
| 6,012,964 | A * | 1/2000 | Arai et al. | 451/5 |
| 6,986,359 | B2 * | 1/2006 | Shajii et al. | 137/14 |
| 2003/0077986 | A1 * | 4/2003 | Schultz et al. | 451/41 |
| 2003/0181151 | A1 * | 9/2003 | Chao et al. | 451/287 |
| 2005/0199287 | A1 * | 9/2005 | Shajii et al. | 137/487.5 |

* cited by examiner

*Primary Examiner* — Timothy V Eley
(74) *Attorney, Agent, or Firm* — Rosenberg, Klein & Lee

(57) ABSTRACT

A pressure control system of a wafer polishing apparatus includes a main input air pressure regulator, an air branch conduit, a plurality of first pipes, a plurality of auxiliary air pressure regulators, a plurality of second pipes, and a plurality of air pressure controlling devices. The air branch conduit is connected with the main input air pressure regulator. The first pipes are connected between the air branch conduit and the auxiliary air pressure regulators. The second pipes are connected between the auxiliary air pressure regulators and the air pressure controlling devices. Accordingly, the air pressure controlling devices can control the pressure outputted from a polishing head of the wafer polishing apparatus to a surface of a wafer.

9 Claims, 7 Drawing Sheets

PRESSURE CONTROL SYSTEM OF WAFER POLISHING APPARATUS

BACKGROUND OF THE INVENTION

1. Field of the Invention

The present invention relates to a pressure control system, especially for a pressure control system of a wafer polishing apparatus.

2. Description of Related Art

As shown in FIG. 1, a traditional pressure control system for a wafer polishing apparatus includes a main input air pressure regulator 1*a*, an air branch conduit 2*a*, a plurality of air pipes 3*a*, and a plurality of air pressure controlling devices 4*a*. The air branch conduit 2*a* is connected to the main input air pressure regulator 1*a*. Each of the air pipes 3*a* is connected to the air branch conduit 2*a* on one end and, while another end thereof has a plurality of branches 31*a* connected to the air pressure controlling devices 4*a* respectively, which are for controlling the pressure outputted from a polishing head of the wafer polishing apparatus to a wafer.

In order to ensure the application of sufficient pressure from the polishing heads to the wafer, ideally the pressure value inputted to each of the air pressure controlling devices 4*a* should be maintained at around 25 psi, so that the quality of wafer polishing can be ensured. However, in reality, because the branches 31*a* are in connection with each other, fluctuation of air pressure in these air pressure controlling devices 4*a* frequently occurs. As a result, the pressure value in some of these controlling devices are higher than 25 psi, while others are lower than 25 psi. Moreover, when the pressure value of the air pressure controlling device 4*a* is lower than 25 psi, the polishing head may not be able to apply sufficient output pressure to keep the spinning wafer on the pad of the polishing apparatus. In extreme situations, the wafer may even be thrown off the pad of the polishing apparatus. However, when the pressure value of the air pressure controlling device 4*a* is higher than 30 psi to exceed the rated pressure of the air pressure controlling device 4*a*, the air pressure controlling devices 4*a* is damaged and the life of the air pressure controlling device 4*a* is reduced.

Hence, the inventors of the present invention believe that the shortcomings described above are able to be improved and finally suggest the present invention which is of a reasonable design and is an effective improvement based on deep research and thought.

SUMMARY OF THE INVENTION

It is an object of the present invention to provide a pressure control system of a wafer polishing apparatus, and the pressure control system increase the yield of polishing wafers, and prevent the wafer polishing apparatus from being damaged.

To achieve the above object, the present invention provides a pressure control system of a wafer polishing apparatus. The pressure control system includes a main input air pressure regulator, an air branch conduit, a plurality of first pipes, a plurality of auxiliary air pressure regulators, a plurality of second pipes, and a plurality of air pressure controlling devices. The air branch conduit is connected with the main input air pressure regulator. The first pipes are connected between the air branch conduit and the auxiliary air pressure regulators. The second pipes are connected between the auxiliary air pressure regulators and the air pressure controlling devices.

The advantages of the present invention are described below: the auxiliary air pressure regulators can control the pressure in each of the second pipes, so that air-leakage between the air pressure controlling devices is reduced or prevented, thereby improving the output stability of the polishing device and thus ensuring the product yield of the wafer. In addition, the auxiliary air pressure regulators can maintain the air pressure of each of the second pipes to be in the normal rated range, the auxiliary air pressure regulators can prevent the air pressure inputting to the air pressure controlling apparatus from being too high, so that increases the life of the air pressure controlling apparatus.

DETAILED DESCRIPTION OF THE PREFERRED EMBODIMENTS

Figure 1:
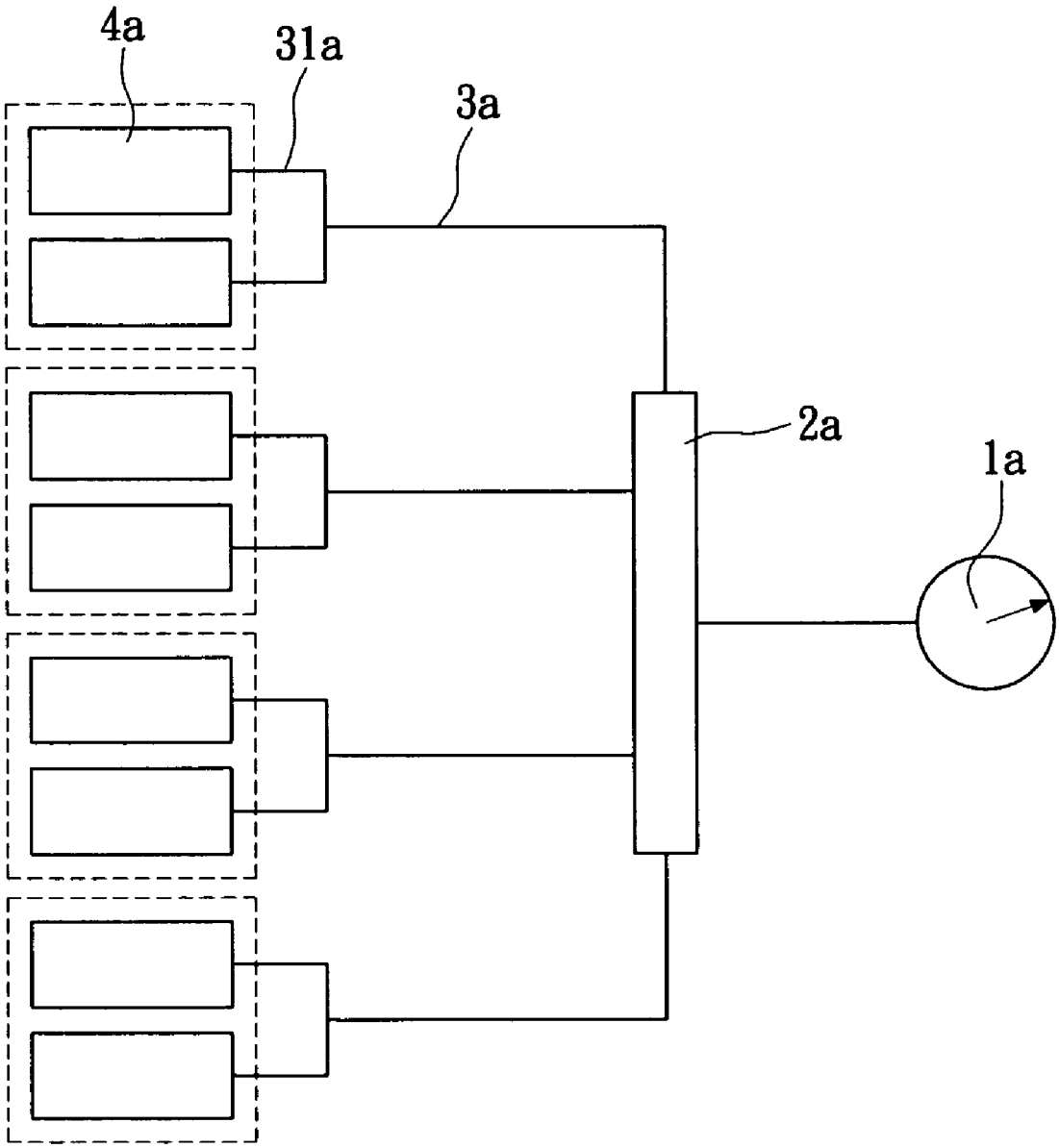
FIG. 1 PRIOR ART
FIG. 1 is the framework of the pressure control system of the wafer polishing apparatus according to the related art.
Figure 2:
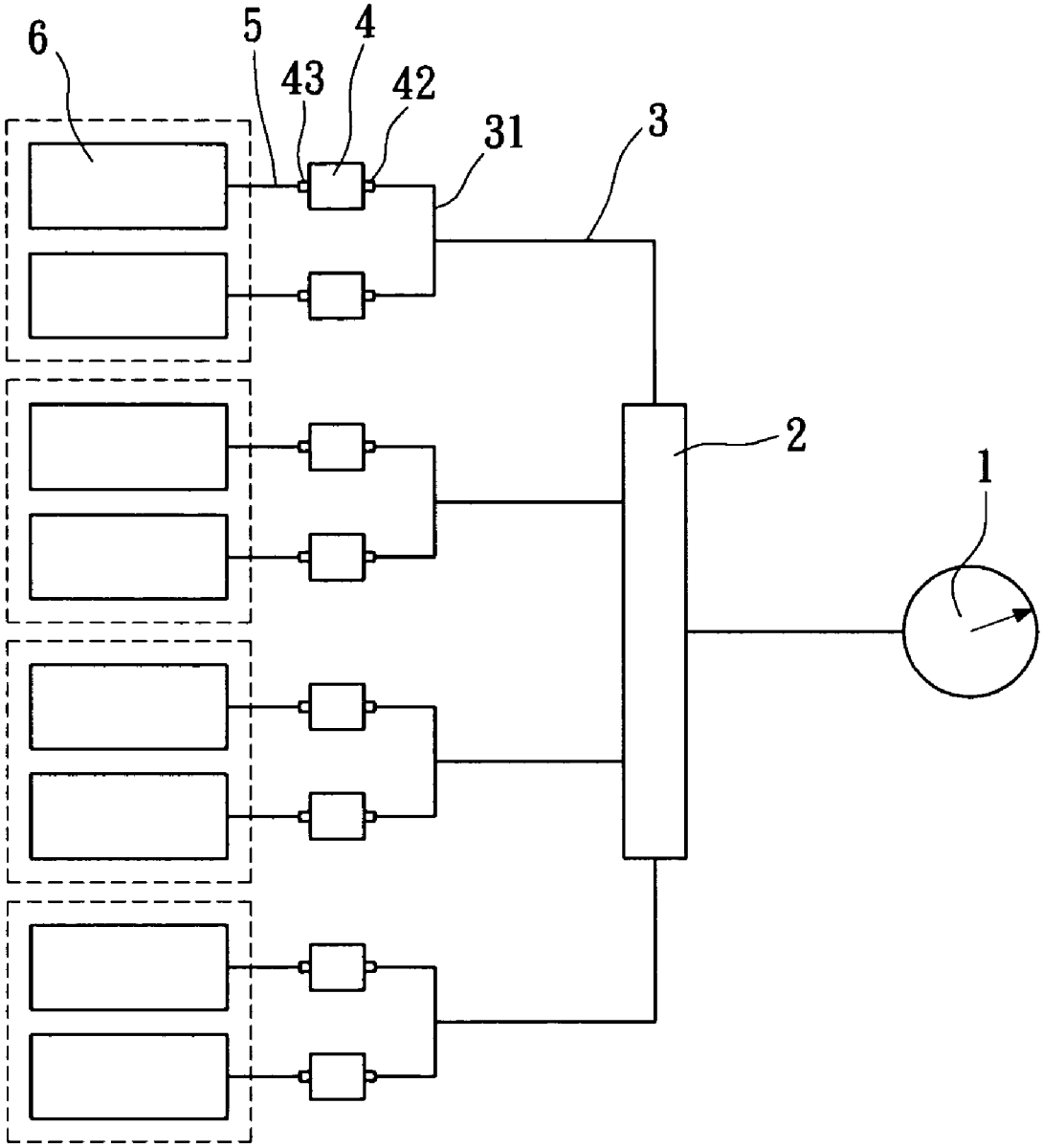
FIG. 2 is the framework of the pressure control system of the wafer polishing apparatus according to the present invention.
Figure 3:
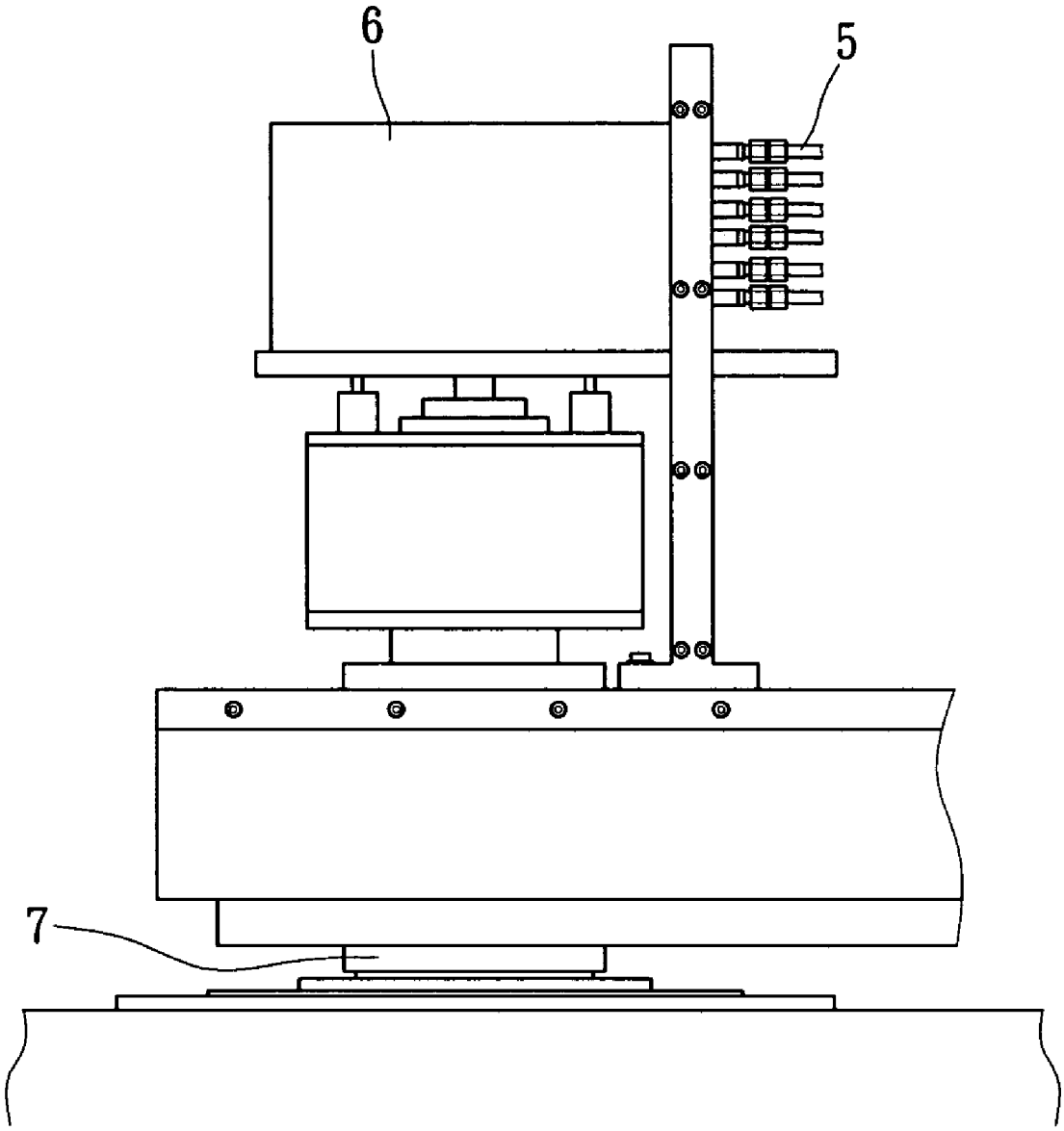
FIG. 3 is a plan view of the pressure control system according to the present invention.

Refer to FIG. 2 and FIG. 3, the pressure control system of the wafer polishing apparatus includes a main input air pressure regulator 1, an air branch conduit 2, a plurality of first pipes 3, a plurality of auxiliary air pressure regulators 4, a plurality of second pipes 5, and a plurality of air pressure controlling devices 6. The air branch conduit 2 is connected to the main input air pressure regulator 1, one end of each of the first pipes 3 is connected to the air branch conduit 2, and the air branch conduit 2 makes the main input air pressure regulator 1 outputs 25 psi pressure to each of the first pipe 3. Another end of each of the first pipes 3 which is apart from the air branch conduit 2 has a plurality of branches 31, the branches 31 are connected with the auxiliary air pressure regulators 4 respectively, two ends of each of the second pipes 5 are connected between each of the auxiliary air pressure regulators 4 and each of the air pressure controlling devices 6, and the air pressure controlling devices 6 can control a pressure outputted from a polishing head 7 of the wafer polishing apparatus to a surface of a wafer.

Figure 4:
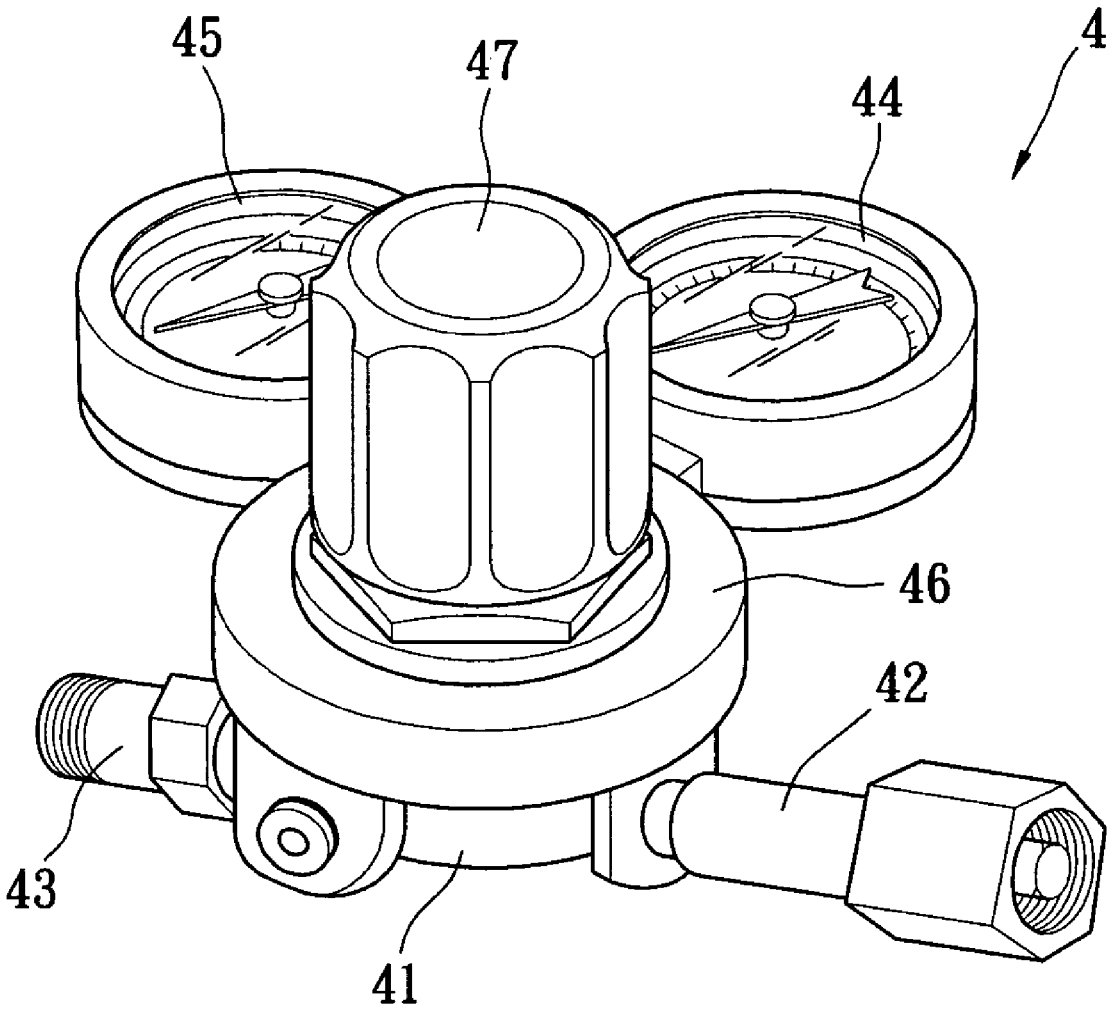
FIG. 4 is a perspective view of the auxiliary air pressure regulator according to the present invention.
Figure 5:
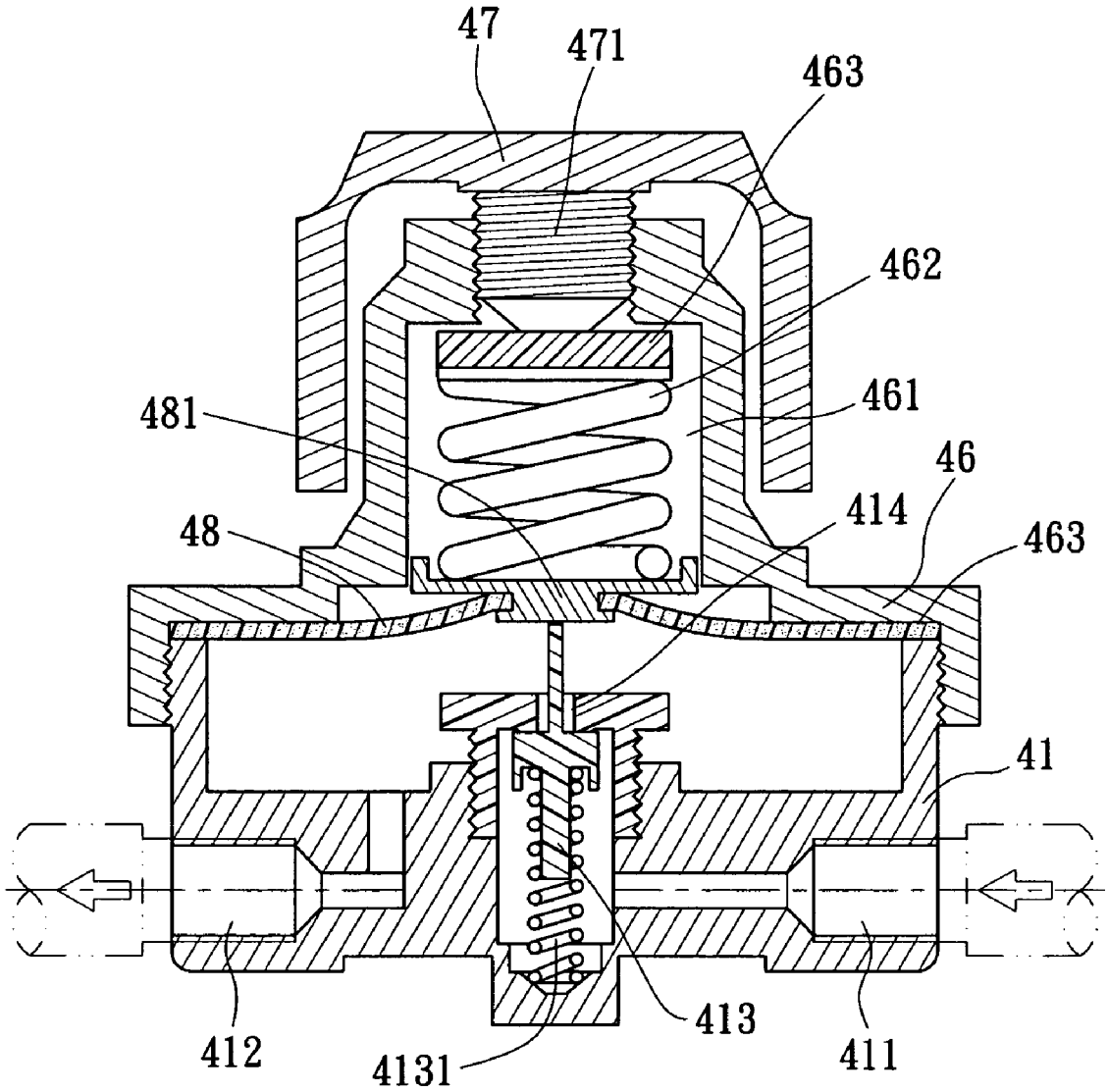
FIG. 5 is a cross-sectional view of the auxiliary air pressure regulator according to the present invention.

Refer to FIG. 4 and FIG. 5, each of the auxiliary air pressure regulators 4 includes a body 41, an air intake pipe 42, and an air outtake pipe 43, and the body 41 has a first pressure chamber 411, a second pressure chamber 412 and an air valve 413 formed therein. The air intake pipe 42 is connected with the body 41 and the branches 31(shown in FIG. 2), and the air intake pipe 42 is connected with the first pressure chamber 411. The air outtake pipe 43 is connected with the body 41 and the second pipes 5 (shown in FIG. 2), and the air outtake pipe 43 is connected with the second pressure chamber 412. When the air of the first pressure chamber 414 flows to the second pressure chamber 412, the air of the first pressure chamber 414 must pass through an air hole 414 firstly. The air valve 413 is mounted inside the body 41, and the air valve 413 has a first spring 4131. When the first spring 4131 moves upwardly, the air valve 413 stuffs the air hole 414 to stop the air of the first pressure chamber 414 flowing to the second pressure chamber 412.

A first manometer 44 and a second manometer 45 are connected with the body 41, the first manometer 44 connects with the first pressure chamber 411, the second manometer 45 connects with the second pressure chamber 412, and the first manometer 44 and the second manometer 45 can display the air pressure of the first pressure chamber 411 and the air pressure of the second pressure chamber 412.

An upside of the body 41 is connected to a top cover 46. A receiving chamber 461 is defined inside the top cover 46. Knob 47 having a screw portion 471 is fastened on the upside of the top cover 46 and extendable into the receiving chamber 461. A second spring 462 is mounted inside the receiving chamber 461, a first washer 463 is connected between an upside of the second spring 462 and the screw 471, and the screw 471 presses on the first washer 463.

A colloid film 48 is arranged between an underside of the top cover 46 and the body 41, a second washer 481 is connected between an underside of second spring 462 and the colloid film 48, and the second spring 462 presses on the second washer 481.

When the knob 47 is rotated by a user, the screw 471 will press on the second spring 462, so that the vertical position of the second washer 481 can be controlled. When the pressure outputted from the second spring 462 which is up to the second washer 481 is higher than the air pressure of the first pressure chamber 411 and the air pressure of the second pressure chamber 412, the air valve 413 will be moved downwardly via the second spring 462 and the air hole 414 will be opened. Conversely, when the internal pressure of the receiving chamber 461 (the location around the second spring 462 and above the second washer 481) is lower than the first pressure chamber 411 and the air pressure of the second pressure chamber 412, the air valve 413 will be moved upwardly via the first spring 4131 and the air hole 414 will be closed, so that the air pressure of second pressure chamber 412 can be regulated via controlling the state (open/close) of the air hole 414.

Figure 6:
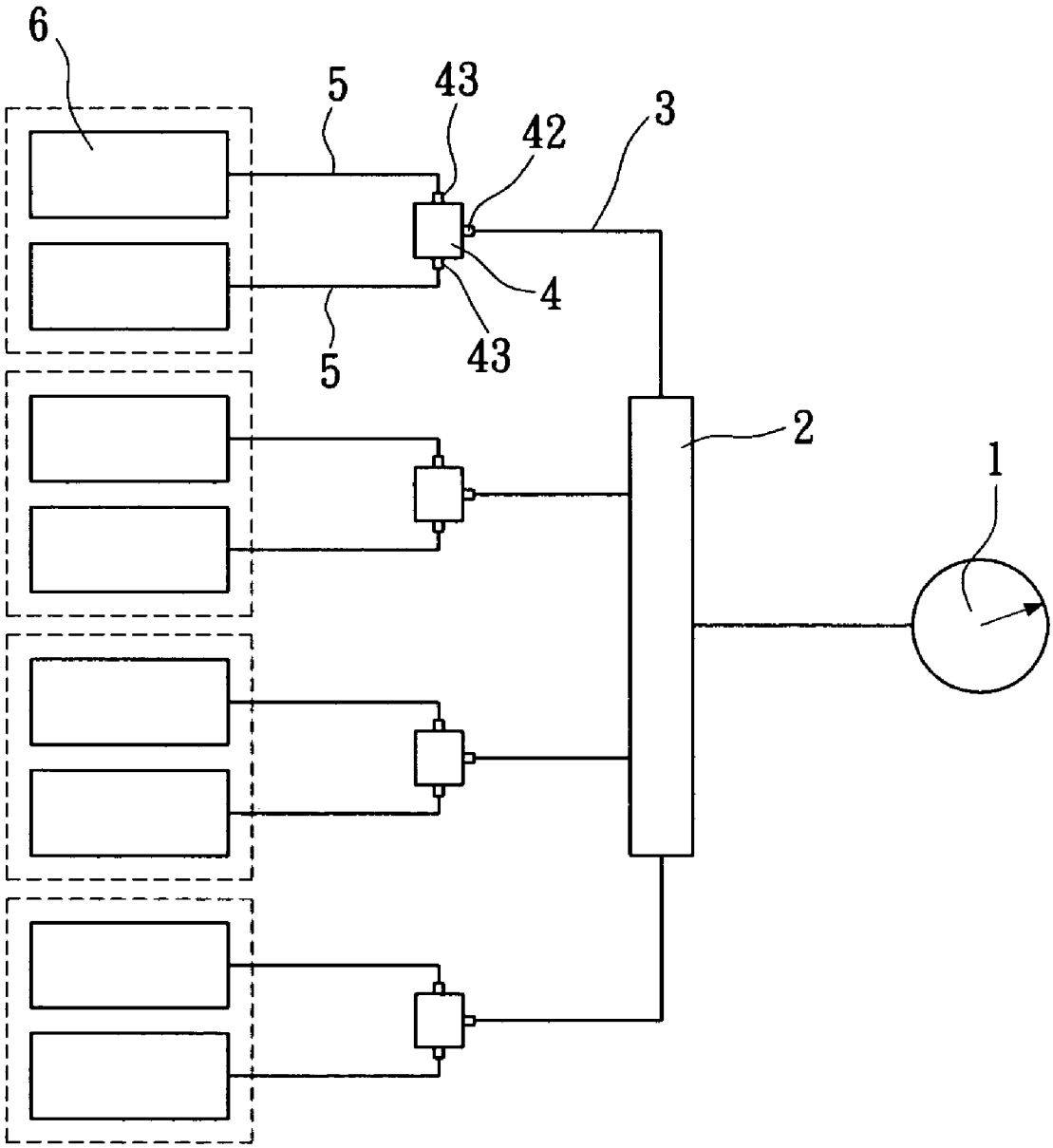
FIG. 6 is another embodiment of the pressure control system according to the present invention.

As shown in FIG. 6, another embodiment of the present invention is presented, each of the auxiliary air pressure regulators 4 has one air intake pipe 42 and a plurality of air outtake pipes 43, the air intake pipes 42 are connected with the first pipes 3 respectively, and the outtake pipes 43 are connected with the second pipes 5 respectively.

Figure 7:
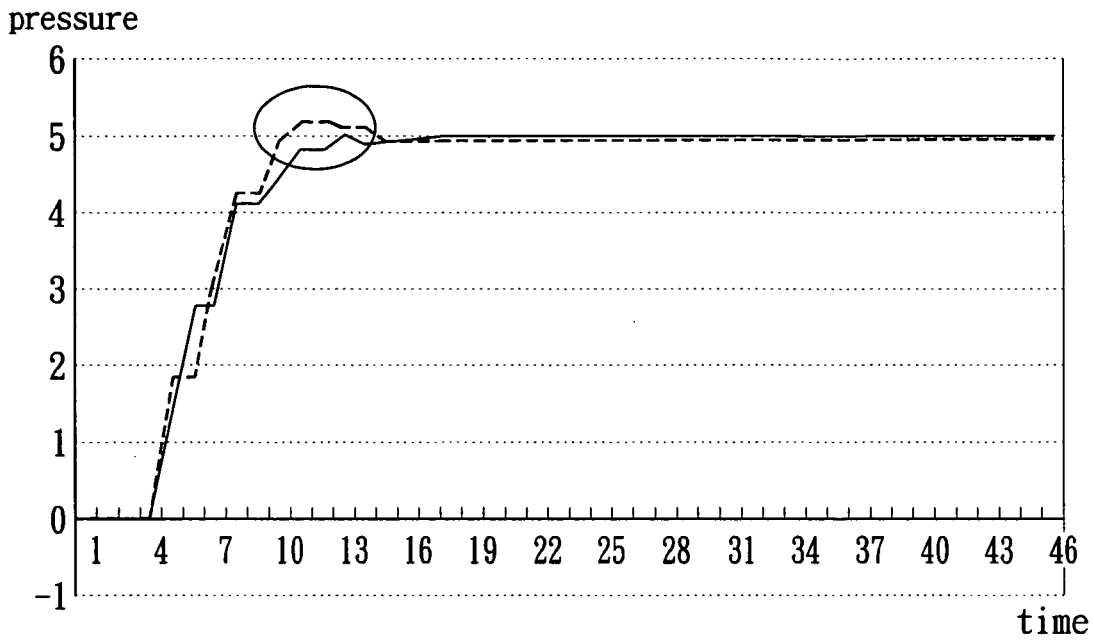
FIG. 7 is a first view of the output pressure comparison between the air pressure controlling apparatus of the present invention and the air pressure controlling apparatus of the related art.

As shown in FIG. 7, when the air pressure outputted from the main input air pressure regulator 1 is 30 psi, a user regulates the auxiliary air pressure regulators 4 to control the pressure value of each of the air pressure controlling devices 6 outputted to a polishing head 7. The pressure are controlled by the auxiliary air pressure regulators 4, to ensure that the pressure value does not exceed the steady state of the pressure value (as shown in solid line), but the pressure value controlled by the pressure control system of the related art is over the steady state pressure value (as shown in dash line).

Figure 8:
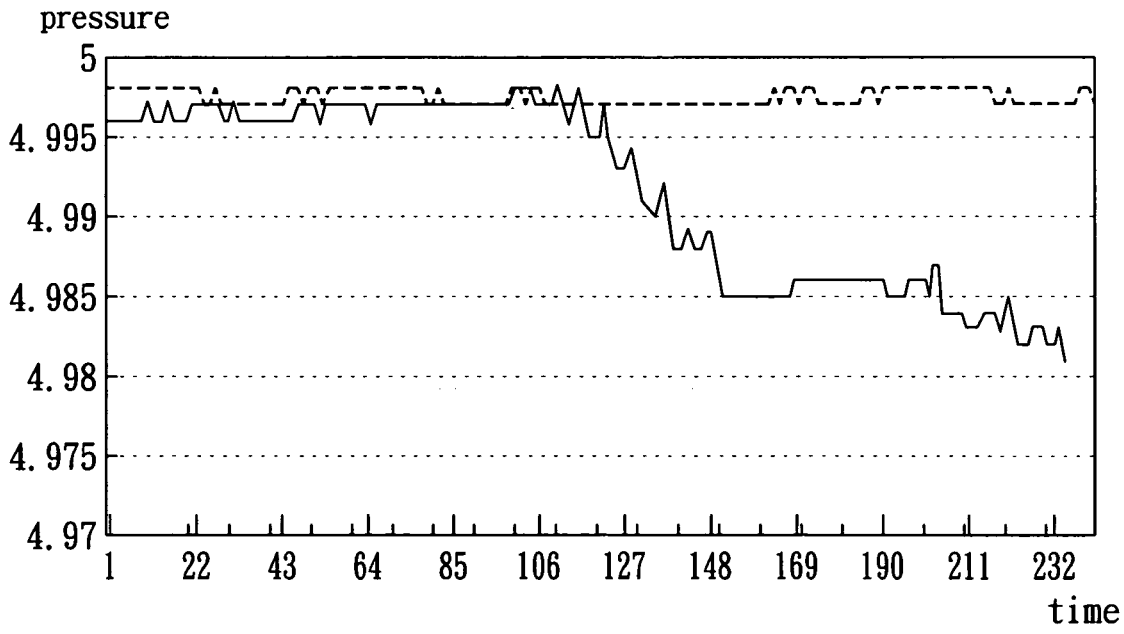
FIG. 8 is a second view of the output pressure comparison between the air pressure controlling apparatus of the present invention and the air pressure controlling apparatus of the related art.

As shown in FIG. 8, when the air pressure outputted from the main input air pressure regulator 1 is decreased from 30 psi to 25 psi, the auxiliary air pressure regulators 4 can regulate the output pressure from each of the air pressure controlling devices 6 to maintain to be a steady state value (as shown in dash line), but the output pressure from the air pressure controlling device of the related art is decreased (as shown in solid line).

The advantages of the pressure control system of the present invention are described below:

1. The auxiliary air pressure regulator 4 controls the pressure of each of the second pipes 5, so that the air-leakage between the air pressure controlling apparatuses 6 and the auxiliary air pressure regulators 4 may be reduced or prevented. Thus, the auxiliary air pressure regulator 4 can control air pressure of each of the second pipes 5 to maintain to be in a steady state value, even if the air pressure outputted from the main input pressure regulator 1 is changed, the output pressure from the air pressure controlling apparatus 6 will not be changed seriously, so that the stability of each air pressure controlling apparatus 6 is higher and the yield of polishing wafers is increased.

2. The auxiliary air pressure regulator 4 controls the pressure of each of the second pipes 5, so that each of the air pressure controlling device 6 is capable of outputting enough pressure to the polishing head 7, so that the polishing head 7 can output enough pressure to the wafer and thus keep it from being thrown off the polishing apparatus during a polishing process.

3. The pressure of each of the second pipes 5 can be controlled in the rated pressure range of the air pressure controlling device 6, so that the auxiliary air pressure regulators 4 can prevent the pressure of each of the air pressure controlling apparatuses 6 from being too high, so that the life of each of the air pressure controlling apparatuses 6 can be increased.

What are disclosed above are only the specification and the drawings of the preferred embodiment of the present invention and it is therefore not intended that the present invention be limited to the particular embodiment disclosed. It will be understood by those skilled in the art that various equivalent changes may be made depending on the specification and the drawings of the present invention without departing from the scope of the present invention.

What is claimed is:

1. A pressure control system of a wafer polishing apparatus, comprising:

a main input air pressure regulator;

an air branch conduit connected to the main input air pressure regulator;

a plurality of first pipes, wherein one end of each of the first pipes is connected to the air branch conduit;

a plurality of auxiliary air pressure regulators, wherein each of the auxiliary air pressure regulators is connected to another end of one of the first pipes;

a plurality of second pipes, wherein one end of each of the second pipes is connected to one of the auxiliary air pressure regulators; and a plurality of air pressure controlling devices, wherein each of the air pressure controlling devices is connected to another end of one of the second pipes, so that the air pressure controlling devices can control a pressure outputted from a polishing head of the wafer polishing apparatus to a surface of a wafer.

2. The pressure control system as claimed in claim 1, wherein each of the first pipes has a plurality of branches connected to two of the auxiliary air pressure regulators, respectively.

3. The pressure control system as claimed in claim 2, wherein each of the auxiliary air pressure regulators includes a body having an air valve, a first pressure chamber and a second pressure chamber formed therein, an air intake pipe and an air outtake pipe, the air intake pipe is connected with the first pressure chamber of the body and the branches, the air outtake pipe is connected with the second pressure chamber of the body.

4. The pressure control system as claimed in claim 3, wherein each of the auxiliary air pressure regulators further includes a top cover disposed on the body defining a receiving chamber and a knob fastened on an upside of the top cover.

5. The pressure control system as claimed in claim 4, wherein each of the auxiliary air pressure regulators further includes a colloid film arranged between an underside of the top cover and the body.

6. The pressure control system as claimed in claim 5, wherein the knob is fastened on the upside of the top cover through a screw portion and extendable into the receiving chamber.

7. The pressure control system as claimed in claim 6, wherein each of the auxiliary air pressure regulators further includes a spring arranged in the receiving chamber, a first washer disposed between the screw and the upper end of the spring, the spring urging the first washer against the screw, and a second washer disposed between the colloid film and the lower end of the spring, the spring abutting the second washer.

8. The pressure control system as claimed in claim 3, wherein each of the auxiliary air pressure regulators further includes a first manometer and a second manometer, the first manometer connects with the first pressure chamber of the body, the second manometer connects with the second pressure chamber of the body.

9. The pressure control system as claimed in claim 1, wherein each of the auxiliary pressure regulators has an input pipe and a plurality of output pipes, the input pipe connects to the first pipe, and the output pipes connect to the second pipes, respectively.

* * * * *